United States Patent [19]

Cizek

[11] Patent Number: 4,871,024

[45] Date of Patent: Oct. 3, 1989

[54] FLUID FOR TREATMENT OF A SUBTERRANEAN WELL FOR ENHANCEMENT OF PRODUCTION

[75] Inventor: Arthur Cizek, Houston, Tex.

[73] Assignee: Baker Performance Chemicals Inc., Houston, Tex.

[21] Appl. No.: 226,468

[22] Filed: Aug. 1, 1988

[51] Int. Cl.[4] ..... E21B 41/02; E21B 43/27

[52] U.S. Cl. ..... 166/307; 166/242; 166/902; 252/8.553; 252/8.555

[58] Field of Search ..... 166/271, 300, 307, 310, 166/371, 902; 252/8.552, 8.553, 8.555

[56] References Cited

U.S. PATENT DOCUMENTS

| | | | |
|---|---|---|---|
| 2,982,360 | 5/1961 | Morton et al. | 166/902 X |
| 3,773,465 | 11/1973 | Keeney et al. | 422/12 |
| 3,954,636 | 5/1976 | Crowe et al. | 166/307 X |
| 4,057,108 | 11/1977 | Broussard | 166/902 X |
| 4,213,866 | 7/1980 | Ashby et al. | 166/307 X |
| 4,245,698 | 1/1981 | Berkowitz et al. | 166/902 X |
| 4,500,434 | 2/1985 | Jost et al. | 210/696 |
| 4,609,475 | 9/1986 | Hanlon et al. | 166/307 X |
| 4,670,163 | 6/1987 | Lindstrom et al. | 166/902 X |
| 4,683,954 | 8/1987 | Walker et al. | 166/307 |

*Primary Examiner*—George A. Suchfield

*Attorney, Agent, or Firm*—Hubbard, Thurman, Turner & Tucker

[57] ABSTRACT

An acid soluble copper metal salt intensifier is provided for a fluid for treatment of a subterranean well for enhancement of production within the well by introduction of the fluid through a high alloy steel member positioned within the well. The treatment fluid comprises an acidic injection medium and an acid corrosion inhibitor. The intensifier is introduced into the fluid for deposition on or effective treatment contact with the high alloy steel. A method of inhibiting acidic corrosion and a method of treating a subterranean well for enhanced production also are disclosed.

13 Claims, No Drawings

FLUID FOR TREATMENT OF A SUBTERRANEAN WELL FOR ENHANCEMENT OF PRODUCTION

BACKGROUND OF THE INVENTION (1) Field of the Invention:

The present invention is directed to an acid soluble copper metal salt intensifier for use in a treatment fluid for a subterranean well, the treatment fluid being introduced within a high alloy steel member.

(2) Discussion of the Prior Art:

In the life of a subterranean oil or gas well, it frequently occurs that the production zone within the well must be chemically treated or "stimulated" to enhance the economical production life of the well. It many instances, it is common practice to introduce into the well for contact with or injection into the production zone a highly acidic solution, generally having a pH from between about 1 and 6.9. Because of the acidic nature of such a treatment fluid, the production (or workover) conduit which is utilized in the well in such applications can be expected to encounter considerable acidic corrosion which, in turn, can cause surface pitting, embrittlement, loss of metal component, and the like.

In earlier years of producing subterranean wells, the vast majority of production and workover conduits which were utilized either temporarily or permanently in the well and through which a treatment or stimulation fluid was introduced into the well comprised carbon steels, such as J-55, P-105, N-80, and the like. Recently, however, due primarily to the drilling and completion of many subterranean wells through formations which contain hydrogen sulfide, carbon dioxide, brine, and combinations of these constituents, the production and workover conduits for use in the wells have been made of high alloy steels. The high alloy steels, as used herein, include stainless steels, high nickel content steels, and steels containing alloy 625 or C-276 in clad plates, or the like.

Stainless steels, first commercially developed in the 1920's, obtain their corrosion resistance by incorporation of a surface oxide film or adsorbed oxygen, of about 10 to 100 angstroms thickness. These stainless steels may be classified by their general structure and properties as: (1) martensitic; (2) ferritic; (3) austenitic; (4) duplex; and (5) precipitation-hardening steels.

Martensitic alloy steels are magnetic and are hardenable by heat treating procedures. In subterranean well environments, they may be used for mild corrosion and high temperature service. Typical of such martensitic alloys is UNS S41000 (alloy 410) which contains from between about 11.5% and about 13.5% chromium, about 0.15% carbon and no nickel.

Ferritic alloys are similar to martensitic alloys in that they, also, are magnetic. However, ferritic alloys ar not hardenable by heat treatment and have corrosion resistance between alloys 410 and 304. They are also immune to chloride stress corrosion cracking and have a ductile to brittle transition temperature which somewhat limits their use in subterranean oil well environments. Exemplary of such ferritic alloys is UNS S44735, which contains from between about 28.0 to about 30.0% chrome, about 1% nickel, from between about 3.6% to about 4% molybdenum, and trace amounts of copper, nitrogen, titanium and niobium.

Austenitic stainless steels are non-magnetic and hardenable by cold work, and, like ferritic alloys, are not hardenable by heat treatment. Typical of such stainless steels is UNS S31603 (Alloy 316L), which contains from between about 6 and 18% chrome, from between about 10 and about 14% nickel, with traces of copper and molybdenum. Also typical of such austenitic stainless steels is UNS N08020 (Alloy 20); UNS N08825 (Alloy 825); and UNS N08904 (Alloy 904L), which contains from between about 19 and about 23% chrome, from between about 23 and about 45% nickel, and from between about 2 and about 5% molybdenum, with small percentages of copper along with other elements. Variants of these steels, such as S31254, N08026 and N08925, which contain up to about 6% molybdenum, are also classified as austenitic stainless steels and have high chloride resistance, and are particularly effective when exposed and utilized in such environments.

Duplex steels combine ferrite and austenite steels and have 2 to 3 times a yield strength of the austenitic stainless steels. A duplex stainless steel family is resistant to pitting and crevice corrosion and has significantly better CSCC resistance, than do the 300 series stainless steel products. Such steels have favorable toughness and ductility properties, with a coefficient of expansion nearer to that of carbon steel, thus reducing stress factors. Heat transfer in such stainless steels is about 25% greater than that of the austenitic steels.

Precipitation-hardening stainless steels attribute their high strength to the precipitation of a constituent from a super saturated solid solution through a relatively simple heat treatment but do not encounter a loss in resistance to corrosion or ductility. These steels may be heat treated. Typical of such steels are UNS S17400 (17-4 PH) and UNS S15700 (PH 15-7 Mo), which contains from between about 14 to about 16% chromium, and from 2 to 3% molybdenum, with from between about 6.5% and about 7.8% nickel.

Other high alloy steels include those having high nickel content. Typical of such high nickel alloys are UNS N10276 (Alloy C-276); UNS N06625 (Alloy 625); and UNS N06110. These high nickel alloy materials are used to prepare tubular goods for subterranean wells, and other components for use within subterranean wells where such use is expected to encounter extremely corrosive environments. The high nickel alloys have high tolerance to extremely hostile environments and typically contain about 60% nickel, from between about 15 to about 20% chromium, and from between about 9 and about 16% molybdenum.

U.S. Pat. No. 3,773,465 is typical of the prior art with respect to treatment of low alloy, or N-80-type production conduits with intensified acid corrosion inhibitor compositions, and discloses the treatment of such conduits with cuprous iodide.

In the present invention, it has been found that high alloy steels, as opposed to low alloy members, may be effectively protected against the effects of acid corrosion by utilizing an acid soluble copper metal salt intensifier.

SUMMARY OF THE INVENTION

The present invention provides a fluid for treatment of a subterranean well for enhancement of production within the well by introduction of the fluid through a high alloy steel member positioned within the well. The fluid comprises an acidic injection medium and an acid corrosion inhibitor which is intensified by introduction into the treatment fluid and contact with the high alloy steel member of an acid soluble copper metal salt intensifier, the intensifier preferably being selected from the class consisting of cuprous chloride, copper acetate, cupric ormate, and cupric nitrate.

The invention also comprises a method of treating a well for enhancement of production within a production zone by introduction into said high alloy steel member of an intensified acid corrosion inhibitor composition for contact with and effective corrosion inhibition treatment of said member.

The present invention also is directed to a method of inhibiting acid corrosion of a high alloy steel member positioned within a subterranean well by contacting the high alloy steel surface with an effective acidic corrosion inhibiting amount of a composition containing an intensifier for the corrosion inhibitor which is deposited on the high alloy steel surface for effective corrosion inhibition treatment contact with the surface.

DESCRIPTION OF THE PREFERRED EMBODIMENTS

The fluid which is contemplated for use in the present invention for treatment of a subterranean well for enhancement of production will be aqueous-based: that is, it will be formed using sea water available at the preparation location, a brine, tap water, or similar fluid. The amount of the fluid used for the treatment will vary, of course, from well to well, and will be based upon the particular application at hand, and the amount thereof is not particularly critical to the present invention.

The high alloy steel member which is introduced into the well may be provided either in the form of a section or string of workover tubing, or may be permanently implaced production tubing. It may also be and include, as opposed to tubing per se, any high alloy steel surface, such as the lining of down hole pumps, gas separators, packer mandrels, tubing hangers, safety valves, side pocket mewndrels, wire line tools, and the like. In any event, by use of the phrase "high alloy steel conduit" we mean to generally refer to an oil country tubular goods or metal surfaces of down hole equipment of a stainless steel or high nickel steel, as described above. Preferably, such high alloy steel members will be provided in the form of 2205 Steel, which generally contains about 22% by weight chrome and about 5% by weight nickel, with the balance of the materials varying depending upon the source of the conduit or surface of the member. Alternatively, high alloy steel conduits may also be formed of tubing joints having about 13% by weight chrome. This tubing normally is provided in 30 foot to 60 foot sections or "joints" which are threadedly secured one to another and introduced into the well to form a string of a tubular conduit which has its lower end positioned immediate a production zone, or location, in the well to be treated.

If this tubing is provided in the form of a workstring, it may be retrieved from the well. If the tubing is production tubing, it will be cemented in place at some time during the early life of the well, and before treatment of the subterranean well zone. If the steel is used in down hole equipment of a non-conduit nature, it may be permanently placed, or may be retrievable.

The treatment fluid has as a primary additive an acidic injection medium which may be any compatible strong acid, such as hydrochloric, hydrofloric, acetic, and mixtures thereof.

The treatment fluid also contemplates incorporation of an acid corrosion inhibitor which typically will be provided in treatment concentrations of from between about 1,000 ppm based upon the weight of the entire treatment fluid to about 60,000 ppm of such weight. Of course, the treatment level of the acid corrosion inhibitor will vary depending upon particular physical characteristics of the well, the high alloy steel conduit, temperature and pressure considerations, the selected acidic injection medium, and the like.

The acid corrosion inhibitor to be combined with the acidic injection medium and the intensifier can be any acetylenic compound, a nitrogen compound, or a mixture thereof, as is well known to those skilled in the art. For example, acid corrosion inhibitors as made and described in U.S. Pat. Nos. 3,514,410; 3,404,094; 3,107,221; 2,993,863; and 3,382,179, may be utilized in accordance with the present invention.

Examples of acetylenic compounds which may be used include hexynol, dimethyl hexynol, diethyl hexynediel, dimethyl hexynediol, dimethyl octynediol, methyl butynol, methyl pentynol, ethynyl cyclohexynol, 2-ethyl hexynol, phenyl butynol, and ditertiary acetylenic glycol.

Other acetylenic compounds which can be employed in accordance with the present invention are for example, butynediol, 1-ethynylcyclohexanol, 3-methyl-1-nonyn-3-ol, 2-methyl-3-butyn-2-ol, also 1-propyn-3-ol, 1-butyn-3-ol, 1-pentyn-3-ol, 1-heptyn-3-ol, 1-octyn-3-ol, 1-nonyn-3-ol, 1-decyn-3-ol, 1-(2,4,6-trimethyl-3 cyclohexenyl)-3-propyne-1-ol, and in general acetylenic compounds having the general formula

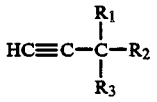

wherein $R_1$ is —H, —OH, or an alkyl radical; $R_2$ is —H, or an alkyl, phenyl, substituted phenyl or hydroxy-alkyl radical; and $R_3$ is —H or an alkyl, phenyl, substituted phenyl or hydroxyalkyl radical.

Acetylenic sulfides having the general formula

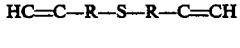

can also be employed in the present invention in lieu of acetylenic alcohols. Examples of these are dipropargyl sulfide, bis (1-methyl-2-propynyl) sulfide and bis (2-ethynyl-2-propyl) sulfide.

The nitrogen or ammonia compounds that can be employed in accordance with the present invention are those amines such as mono, di and trialkyl amines and quaternary amines having from one to twenty-four carbon atoms in each alkyl moiety as well as the six membered heterocyclic amines, for example, alkyl pyridines crude quinolines and mixtures thereof. This includes such amines as ethylamine, diethylamine, triethylamine, propylamine, dipropylamine, tripropylamine, mono, di and tripentylamine, mono, di and trihexylamine and isomers of these such as isopropylamine, tertiary-butylamine, etc. This also includes alkyl pyridines having from one to five nuclear alkyl substituents per pyridine moiety, said alkyl substituents having from one to 12 carbon atoms and preferably those having an average of six carbon atoms per pyridine moiety, such as a mixture of high boiling tertiary-nitrogen - heterocyclic compounds, such as HAP (High Alkyl Pyridines), Reilly 10–20 base and Alkyl Pyridines HB. Other nitrogen compounds include the crude quinolines having a variety of substituents.

The inhibitor may also contain a number of other constituents, such as nonyl phenol adducts and tallow amine adducts, tall oil adducts, as surfactants. Oil wetting components such as heavy aromatic solvents, may also be present.

The third component of the treatment fluid of the present invention is an intensifier for the acid corrosion inhibitor. The intensifier may be added to the treatment fluid independently and separately of the acid corrosion inhibitor. Alternatively, the intensifier may be a component part of the acid corrosion inhibitor. In either event, the intensifier is provided for purposes of assisting, aiding and amplifying the corrosion inhibition effects of the acid corrosion inhibitor.

Although not fully understood, it is believed that the presence of the intensifier in the treatment fluid will cause the acid corrosion inhibitor to treat the high alloy steel conduit just as though it were made essentially of iron and permit an electro-chemical attraction of the copper ion to the high alloy steel conduit surface to provide a fine film or barrier to prevent metallic corrosion and pitting.

It has been noted that the effects of incorporation of intensifier may be masked or abated when some inhibitor treatment levels are increased. However, use of the intensifier will, under most circumstances, increase the corrosion inhibition properties of the inhibitor.

The intensifier contemplated for use in the present invention is any acid soluble copper metal salt, and preferably is a member selected from the class consisting of cuprous chloride, cuprous acetate, cuprous formate and cuprous nitrate. Generally speaking, it is preferred to utilize cuprous chloride, although the selected intensifier will depend upon the particular application at hand, the high alloy steel conduit utilized, temperature and pressure factors, the particular selected acid corrosion inhibitor, the acid utilized, and the water used to form the treatment fluid. Those skilled in the art will be able to select the best intensifier for the particular application at hand by pre-testing techniques as utilized in the working examples, below. Again, the amount of intensifier incorporated in the acid injection medium with the acid corrosion inhibitor will vary, depending upon the variables, described above, but will typically be no less than about 1 pound per thousand gallons of acidic injection medium and no more than about 100 pounds per thousand gallons of acid injection medium.

The following working examples further illustrate the present invention:

EXAMPLE I

Corrosion rate and surface pitting tests were performed on test coupons of chrome 13 and 2205 duplex steels in a simulated treatment fluid comprising water containing hydrochloric acid, with the acidic injection medium being provided in the form of 15% hydrochloric acid. To the treatment fluid with the acidic injection medium provided therein was added 10 gallons per thousand gallons of fluid of selected, commercially available inhibitors, "A through G". The generic composition of such sample inhibitors can be generally described as follows:

| Inhibitor | Generic Description |
|---|---|
| A | heterocyclic mannich reaction product |
| B | heterocyclic quaternary self intensified |
| C | heterocyclic quaternary self intensified |
| D | heterocyclic quaternary self intensified |
| E | heterocylic quaternary self intensified |
| F | heterocyclic mannich reaction product |
| G | heterocyclic quaternary self intensified |

After introduction of the selected inhibitor to the treatment fluid, the samples were divided with each being treated first with cuprous chloride as the intensifier in an amount of five pounds per thousand gallons of acidic injection medium. A second sample was also prepared with each of the respective inhibitors "A through G" and the amount of the intensifier was increased to 10 pounds per thousand gallons of the acidic injection medium. The simulated treatment fluid with the respective acid corrosion inhibitor and intensifier additions were then placed into high temperature/high pressure corrosion test cells to which were added test coupons of the chrome 13 steel (into only the sample containing five pounds per thousand gallons of inhibitor) and a coupon of the 2205 duplex steel (into only the test sample containing 10 pounds per thousand gallons of inhibitor). The coupons were permitted to remain in the simulated treatment fluid for six hours at 250° F. at 5000 psi. Thereafter, the coupons were removed from the test cell, neutralized, scrubbed and weighed for weight loss described in pounds per square foot. Of course, the lower the weight loss, the more effective the corrosion inhibitor and the intensifier in preventing corrosion.

Because weight loss is not the only test criteria for determining the ability of a given corrosion inhibitor to function satisfactorily in protecting a metal surface, the coupons were also tested and evaluated for possible pitting caused by exposure to the acidic environment of the simulated treatment fluid. After the coupons were removed from the respective test cell, pitting was visually observed using a 10 point scale, with 9 defining the most unsatisfactory result, and indicating extreme pitting and/or delamination. A rating of 0 with respect to pitting was utilized if the coupon, when compared to an untested coupon, appeared approximately the same as the untested coupon. When a rating of 9 was found on any coupon, pitting and/or delamination had occurred over at least 50% of the surface area of the coupon.

In this test, a treatment fluid was prepared that did not contain the intensifier of the present invention, and is reflected below and indicated in the table as "blank". The results of this test indicated that all treatment fluids containing the intensifier of the present invention were satisfactory in increasing the corrosion inhibition properties of the selected acid corrosion inhibitor. The results of this test are set forth in the table below:

TABLE I

| Inhibitor | Amt.[1] | Amount of Intensifier[2] | Analysis Chrome 13 Wt. Loss[3] | Chrome 13 Rating | 2205 Steel Wt. Loss | 2205 Steel Rating |
|---|---|---|---|---|---|---|
| A | 10 | Blank | .280 | 9 | 1.009 | 9 |
| | 10 | 5 | .044 | 6 | | |
| | 10 | 10 | | | .201 | 9 |
| B | 10 | Blank | .059 | 9 | .343 | 9 |
| | 10 | 5 | .013 | 0 | | |
| | 10 | 10 | | | .044 | 9 |
| C | 10 | Blank | .029 | 2 | .038 | 9 |
| | 10 | 5 | .012 | 0 | | |
| | 10 | 10 | | | .024 | 8 |
| D | 10 | Blank | .109 | 9 | .286 | 9 |
| | 10 | 5 | .017 | 1 | | |
| | 10 | 10 | | | .069 | 9 |
| E | 10 | Blank | .004 | 0 | .015 | 3 |
| | 10 | 5 | .002 | 0 | | |
| | 10 | 10 | | | .009 | 1 |
| F | 10 | Blank | .211 | 9 | 1.040 | 9 |
| | 10 | 5 | .027 | 3 | | |
| | 10 | 10 | | | .109 | 9 |
| G | 10 | Blank | .322 | 9 | .963 | 9 |
| | 10 | 5 | .020 | 1 | | |
| | 10 | 10 | | | .089 | 9 |

[1]gallons per thousand of treatment fluid
[2]lbs. per thousand gallons of acidic injection medium
[3]lbs./square feet

EXAMPLE II

Tests were performed and results were evaluated, as in Example I, for purposes of evaluating concentration levels of two selected acid corrosion inhibitor additives. Inhibitor A utilized in this test can be generally described as a heterocyclic quaternary amine, while inhibitor B can be generally described as a heterocyclic quaternary amine, self intensified. Inhibitor A was tested at rates of 20 and 30 gallons per thousand gallons of treatment fluid with ranges of cuprous chloride as the intensifier from zero ("blank") up to 60 pounds per thousand gallons of acidic injection medium. The tested duplex steel was 2205 steel. Inhibitor B was tested in ranges from 10 gallons per thousand gallons of treatment fluid to 30 gallons per thousand gallons of treatment fluid with no cuprous chloride intensifier, as well as with treatment levels of 20 and 40 pounds per thousand gallons of acid injection medium. The results of this test indicated that the incorporation of the intensifier of the present invention in the inhibitors in the simulated test treatment fluid showed a dramatic reduction in weight loss of the treated coupon and no pitting with respect to the treatment levels of the intensifier utilized in conjunction with inhibitor B. Some pitting was noted, however, with the intensifier which was utilized in conjunction with inhibitor A, but the overall performance level was satisfactory. The results of this test are set forth in the example below:

TABLE II

| Inhibitor | Amt.[1] | Amount of Intensifier[2] | Analysis Chrome 13 Wt. Loss[3] | Analysis Chrome 13 Rating |
|---|---|---|---|---|
| A | 30 | Blank | .209 | 9 |
| | 30 | 10 | .082 | 9 |
| | 30 | 20 | .062 | 9 |
| | 30 | 30 | .032 | 9 |
| | 30 | 40 | .021 | 8 |
| | 30 | 50 | .022 | 7 |
| | 30 | 60 | .014 | 5 |
| | 20 | 20 | .062 | 9 |
| | 20 | 40 | .036 | 9 |

TABLE II-continued

| Inhibitor | Amt.[1] | Amount of Intensifier[2] | Analysis Chrome 13 Wt. Loss[3] | Analysis Chrome 13 Rating |
|---|---|---|---|---|
| | 20 | 60 | .018 | 7 |
| B | 30 | Blank | .023 | |
| | 10 | 20 | .006 | 0 |
| | 20 | 20 | .005 | 0 |
| | 30 | 20 | .005 | 0 |
| | 10 | 40 | .006 | 0 |

[1]gallons per thousand of treatment fluid
[2]lbs. per thousand gallons of acidic injection medium
[3]lbs./square feet

EXAMPLE III

Tests were performed and results were evaluated as in Example I. The acid corrosion inhibitor was that identified as inhibitor "E" in Example I. The treatment level was varied from 10 gallons per thousand gallons of treatment fluid to 4 gallons per thousand gallons of treatment fluid. The intensifier utilized in the test was cuprous chloride in treatment levels ranging from 5 pounds per thousand gallons of inhibitor to 15 pounds per thousand gallons of inhibitor. The high alloy steels which were tested were chrome 13 and 2205 steel coupons. The results of this test are set forth below:

TABLE III

| Inhibitor | Amt.[1] | Amount of Intensifier[2] | Analysis Chrome 13 Wt. Loss[3] | Chrome 13 Rating | 2205 Steel Wt. Loss | 2205 Steel Rating |
|---|---|---|---|---|---|---|
| E | 10 | 5 | | | .011 | 2 |
| | 8 | 5 | .002 | 0 | .012 | 2 |
| | 6 | 5 | .003 | 0 | .018 | 6 |
| | 4 | 5 | .005 | 0 | .028 | 9 |
| | 10 | 10 | | | .007 | 1 |
| | 8 | 10 | | | .007 | 1 |
| | 6 | 10 | | | .007 | 2 |
| | 4 | 10 | | | .011 | 6 |
| | 10 | 15 | | | .006 | 0 |
| | 8 | 15 | | | .006 | 0 |
| | 6 | 15 | | | .006 | 0 |
| | 4 | 15 | | | .010 | 2 |
| | 4 | Blank | .010 | 0 | .678 | 9 |
| | 6 | Blank | .006 | 0 | .050 | 8 |
| | 8 | Blank | .004 | 0 | .020 | 4 |
| | 10 | Blank | .004 | 0 | .015 | 3 |

[1]gallons per thousand of treatment fluid
[2]lbs. per thousand of gallons of acidic injection medium
[3]lbs./square feet

EXAMPLE IV

Tests were performed and results were evaluated as in Example I, above, with the inhibitor being that as identified in Example I as inhibitor "E", and the intensifier being cuprous chloride introduced into the treatment fluid in levels varying from 10 pounds per thousand gallons of treatment fluid to 60 pounds per thousand gallons of treatment fluid. The test temperature was increased from 250° F., as in the previous examples, to 300° F. The coupon used was 2205 duplex steel. The results of this test indicated that intensification of the acid corrosion inhibitor was achieved at all treatment levels of intensifier. The results of this test are set forth in Table IV, below:

TABLE IV

| Inhibitor Amount[1] | Amount of Intensifier[2] | Analysis 2205 Steel Wt. Loss[3] | Rating |
|---|---|---|---|
| 10 | 10 | .498 | 9 |
| 10 | 15 | .093 | 9 |
| 10 | 20 | .069 | 9 |
| 10 | 60 | .066 | 9 |
| 15 | 20 | .056 | 9 |
| 15 | 40 | .024 | 9 |
| 15 | 60 | .017 | 9 |
| 20 | 20 | .038 | 9 |
| 20 | 40 | .017 | 9 |
| 20 | 60 | .012 | 5 |
| 25 | 20 | .031 | 9 |
| 25 | 40 | .016 | 9 |
| 25 | 60 | .011 | 5 |
| 30 | 20 | .027 | 9 |
| 30 | 30 | .020 | 9 |
| 30 | 40 | .014 | 9 |
| 30 | 50 | .014 | 7 |
| 30 | 60 | .011 | 5 |
| 10 | Blank | 1.024 | 9 |
| 20 | Blank | .088 | 9 |
| 30 | Blank | .077 | 9 |

[1]gallons per thousand of treatment fluid
[2]lbs. per thousand of gallons of acidic injecton medium
[3]lbs./square feet

EXAMPLE V

Tests were run and results were evaluated as in Examples I and IV, above. The inhibitor was that as used in Example IV, with the treatment levels varying for the inhibitor and the intensifier, as indicated in the table, below. The high alloy steel which was tested was chrom 13 steel. The results of this test indicated favorable corrosion inhibition and non-pitting properties of utilization of the intensifier of the present invention at all treatment levels.

The results of this test are set forth in Table V below:

TABLE V

| Inhibitor | Amt.[1] | Amount of Intensifier[2] | Analysis Chrome 13 Steel Wt. Loss[3] | Rating |
|---|---|---|---|---|
| E | 10 | 10 | .135 | 6 |
| | 10 | 50 | .344 | 8 |
| | 20 | 5 | .232 | 7 |
| | 20 | 10 | .161 | 7 |
| | 20 | 20 | .015 | 1 |
| | 20 | 30 | .015 | 0 |
| | 20 | 40 | .017 | 1 |
| | 20 | 50 | .014 | 1 |
| | 10 | Blank | .242 | 9 |
| | 20 | Blank | .102 | 7 |

[1]gallons per thousand of treatment fluid
[2]lbs. per thousand of gallons of acidic injection medium
[3]lbs./square feet

EXAMPLE VI

Tests were performed and results were evaluated as in previous examples, using inhibitor "E" defined in Example I at varying levels identified in the table below. The intensifier was cuprous chloride, utilized in treatment levels set forth in the table below. The test duration was increased from six hours as in the previous examples, to 24 hours. The coupons which were tested were derived from chrome 13 and 2205 duplex steels. The results of this test indicated that at this increased time, while pitting occurred, as expected, on some of the coupons, satisfactory corrosion inhibition intensification was achieved utilizing the intensifier of the present invention. The results are set forth in Table VI below:

TABLE VI

| Inhibitor | Amt.[1] | Amount of Intensifier[2] | Analysis Chrome 13 Wt. Loss[3] | Rating | 2205 Steel Wt. Loss | Rating |
|---|---|---|---|---|---|---|
| A | 10 | 10 | | | .068 | 9 |
| | 10 | 20 | .486 | 9 | .040 | 9 |
| | 10 | 30 | .124 | 9 | .035 | 9 |
| | 10 | 40 | | | .033 | 9 |
| | 10 | 50 | | | .032 | 9 |
| | 15 | 20 | .010 | 0 | | |
| | 20 | 20 | .009 | 0 | .025 | 9 |
| | 20 | 30 | .007 | 0 | .017 | 5 |
| | 20 | 40 | .005 | 0 | .015 | 5 |
| | 20 | 50 | | | .013 | 3 |
| | 20 | 60 | | | .012 | 2 |
| | 30 | 30 | | | .012 | 2 |
| | 30 | 40 | | | .012 | 2 |
| | 30 | 50 | | | .010 | 1 |
| | 30 | 60 | | | .010 | 1 |
| | 10 | Blank | .348 | 9 | .155 | 9 |
| | 20 | Blank | .035 | 3 | .071 | 9 |
| | 30 | Blank | .012 | 1 | .048 | 9 |

[1]gallons per thousand of treatment fluid
[2]lbs. per thousand gallons of treatment fluid
[3]lbs./square feet

EXAMPLE VII

One of the additionally unique features of the present invention is the compatability of the intensifier with formic acid, which is used frequently as an intensifier itself. Accordingly, tests were performed as in the previous examples for six hours at 250° F., 5000 psi, utilizing 28% hydrochloric acid and coupons made of chrome 13 and 2205 duplex steels. The inhibitor utilized in this example was that as identified as inhibitor "E" in Example I. The intensifier was cuprous chloride used in treatment levels varying from 10 to 30 pounds per thousand gallons of inhibitor. The intensifier of the present invention was compared against samples containing 30 pounds per thousand gallons of acidic injection medium and against samples containing no formic acid. The results of this test are set forth in the table below.

TABLE VII

| Amt. of Inhibitor E[1] | Formic Acid | Amt. of Intensifier[2] | Analysis Chrome 13 Wt. Loss[3] | Rating | 2205 Steel Wt. Loss | Rating |
|---|---|---|---|---|---|---|
| 10 | 30 | 10 | .022 | 0 | .418 | 6 |
| 10 | | 10 | .349 | 8 | .622 | 7 |
| 20 | 30 | 20 | .024 | 0 | .188 | 5 |
| 20 | | 20 | .075 | 5 | .204 | 5 |
| 30 | 30 | 30 | .016 | 0 | .112 | 2 |
| 30 | | 30 | .017 | 1 | .077 | 4 |

[1]gallons per thousand of treatment fluid
[2]lbs. per thousand gallons of acidic injection medium
[3]lbs./square feet

EXAMPLE VIII

Tests were run and results were evaluated as in Example I, above, except the concentration of hydrochloric acid utilized in the treatment fluid was increased to 28%. The inhibitor utilized in this test is that as used in Example I and identified as inhibitor "E". The inhibitor was used in ranges varying from 20 to 30 gallons per thousand gallons of treatment fluid. The intensifier was cuprous chloride in an amount ranging from between 40 and 70 pounds per thousand gallons of inhibitor. The results of this test are set forth below:

TABLE VIII

| Inhibitor[1] | Amt.[2] | Amount of Intensifier[3] | Analysis: Chrome 13 Wt. Loss[4] | Chrome 13 Rating | 2205 Steel Wt. Loss | 2205 Steel Rating |
|---|---|---|---|---|---|---|
| A | 20 | 40 | .030 | 3 | .114 | 3 |
| | 20 | 50 | .017 | 1 | .102 | 3 |
| | 20 | 60 | .018 | 1 | .145 | 3 |
| | 20 | 70 | .011 | 1 | .111 | 3 |
| | 30 | 40 | .012 | 1 | .095 | 3 |
| | 30 | 50 | .012 | 1 | .122 | 3 |
| | 30 | 60 | .013 | 1 | | |
| | 30 | 70 | | | .075 | 3 |

[1]a blank was not tested due to catastrophic corrosion effects on test equipment
[2]gallons per thousand of treatment fluid
[3]lbs. per thousand gallons of acidic injection medium
[4]lbs./square feet

EXAMPLE IX

In the present example, tests were run and results were evaluated as in Example I, but the percentage of hydrochloric acid utilized was increased to 28% and the amount of the cuprous chloride intensifier tested varied from 40 pounds per thousand gallons of acidic injection medium to 70 pounds per thousand gallons of acidic injection medium. The inhibitor which was utilized was as identified in Example I as "E". Chrome 13 and 2205 steel coupons were utilized in the test. The results of this test are set forth below and indicate very favorable corrosion inhibition intensification and reduced pitting by utilization of the intensifier incorporated in the present invention.

TABLE IX

| Inhibitor[1] | Amt.[2] | Amount of Intensifier[3] | Analysis: Chrome 13 Wt. Loss[4] | Chrome 13 Rating | 2205 Steel Wt. Loss | 2205 Steel Rating |
|---|---|---|---|---|---|---|
| A | 40 | 40 | .013 | 1 | .075 | 1 |
| | 40 | 50 | .012 | 1 | .037 | 1 |
| | 40 | 60 | .009 | 1 | .045 | 1 |
| | 40 | 70 | .006 | 0 | .063 | 2 |
| | 60 | 40 | .010 | 0 | .034 | 1 |
| | 60 | 50 | .010 | 0 | .029 | 1 |
| | 60 | 60 | .009 | 0 | | |
| | 60 | 70 | | | .034 | 1 |

[1]a blank was not tested due to catastrophic corrosion effects on test equipment
[2]gallons per thousand of treatment fluid
[3]per thousand gallons of acidic injection medium
[4]lbs./square feet

EXAMPLE X

Tests were run and results were evaluated as in Example VIII, but for 4 hours, at 250° F., 5,000 psi in 28% hydrochloric acid, with the range of the inhibitor utilized being increased, and ranging from 40 to 60 gallons per thousand gallons of acidic injection medium. The results of this test are set forth in the table below:

TABLE X

| Inhibitor[1] | Amt.[2] | Amount of Intensifier[3] | Analysis: Chrome 13 Wt. Loss[4] | Chrome 13 Rating | 2205 Steel Wt. Loss | 2205 Steel Rating |
|---|---|---|---|---|---|---|
| A | 20 | 40 | .016 | 2 | | |
| | 20 | 50 | .014 | 2 | .062 | 1 |
| | 20 | 60 | .009 | 1 | .055 | 1 |
| | 30 | 40 | .008 | 0 | | |
| | 30 | 50 | .008 | 0 | .034 | 1 |

TABLE X-continued

| Inhibitor[1] | Amt.[2] | Amount of Intensifier[3] | Analysis: Chrome 13 Wt. Loss[4] | Chrome 13 Rating | 2205 Steel Wt. Loss | 2205 Steel Rating |
|---|---|---|---|---|---|---|
| | 30 | 60 | .007 | 0 | .045 | 1 |
| | 40 | 50 | .007 | 0 | .039 | 1 |
| | 40 | 60 | | | .022 | 0 |
| | 50 | 50 | | | .024 | 0 |

[1]a blank was not tested due to catastrophic corrosion effects on test equipment
[2]gallons per thousand of treatment fluid
[3]lbs. per thousand gallons of acidic injecton medium
[4]lbs./square feet

EXAMPLE XI

Tests were performed and results were evauuated as in Example I. However, the pressure at which the test was performed was reduced from 5000 psi to 4000 psi. The acid corrosion inhibitor is a commercially available inhibitor identified as CRONOX® 265 manufactured and sold by Baker Performance Chemicals, Inc., Houston, Tex., and generically described as a heterocyclic quaternary amine. This acid corrosion inhibitor was tested using 30 gallons per thousand gallons of treatment fluid. The intensifiers utilized in this test were cuprous chloride, cuprous acetate, cuprous formate, and cuprous nitrate. The treatment level of the intensifier varied from 10 to 60 pounds per thousand gallons of the tested acid corrosion inhibitor. The results of this test are set forth in the table below.

®Registered trademark by Baker Performance Chemicals, Inc.

TABLE XI

| Amt. of Cronox 265[1] | Intensifier | Amt.[2] | Analysis: Chrome 13 Wt. Loss[3] | 2205 Steel Wt. Loss |
|---|---|---|---|---|
| 30 | | | .174 | .209 |
| 30 | $Cu_2Cl_2$ | 10 | .013 | .082 |
| 30 | $Cu_2Cl_2$ | 20 | .007 | .062 |
| 30 | $Cu_2Cl_2$ | 30 | .006 | .032 |
| 30 | $Cu_2Cl_2$ | 40 | .005 | .021 |
| 30 | $Cu_2Cl_2$ | 50 | .004 | .022 |
| 30 | $Cu_2Cl_2$ | 60 | .001 | .014 |
| 20 | $Cu_2Cl_2$ | 20 | .010 | .062 |
| 20 | $Cu_2Cl_2$ | 40 | .010 | .036 |
| 20 | $Cu_2Cl_2$ | 60 | .002 | .018 |
| 10 | $Cu_2Cl_2$ | 20 | .010 | |
| 10 | $Cu_2Cl_2$ | 40 | .010 | |
| 10 | $Cu_2Cl_2$ | 60 | .002 | |
| 30 | $Cu(Acetate)_2$ | 20 | .016 | .062 |
| 30 | $Cu(Acetate)_2$ | 40 | .009 | .039 |
| 30 | $Cu(Acetate)_2$ | 60 | .007 | .023 |
| 30 | $Cu(Formate)_2$ | 20 | .012 | .059 |
| 30 | $Cu(Formate)_2$ | 40 | .008 | .022 |
| 30 | $Cu(Formate)_2$ | 60 | .006 | .021 |
| 30 | $Cu(NO_3)_2$ | 20 | .013 | .041 |
| 30 | $Cu(NO_3)_2$ | 40 | .013 | .080 |
| 30 | $Cu(NO_3)_2$ | 60 | .014 | .051 |

[1]gallons per thousand of treatment fluid
[2]lbs. per thousand gallons of acidic injection medium
[3]lbs./square feet Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of inhibiting a high alloy steel surface positioned within a subterranean well against acid corrosion, comprising the steps of:

(1) introducing into said well through said high alloy steel surface a fluid for treatment of a subterranean well for enhancement of production within the well comprising an acidic injection medium, and acid corrosion inhibitor, and an intensifier for deposition on and effective treatment contact said high alloy surface comprising a acid soluble copper metal salt; and (2) forming a fine film on said high alloy steel surface through which said fluid is introduced into said well by contacting said surface with said acid corrosion inhibitor in an amount of from between about 0.01% and about 6% of said acidic injection medium and said intensifier in an amount of from between about 0.001% and about 1% of said acidic injection medium, to thereby provide an electrochemical attraction of the copper ion of said intensifier within said film to the high allow steel surface.

2. The method of claim 1 wherein said intensifier is introduced into said treatment fluid as a component in said acid corrosion inhibitor.

3. The method of claim 1 wherein said intensifier is introduced into said fluid independent of said acid corrosion inhibitor.

4. The method of claim 1 wherein the acidic injection medium comprises from between about 1% and about 99% of said fluid; said acid corrosion inhibitor comprising between about 0.01% and about 6% of said acidic injection medium; and said intensifier is introduced in said fluid in an amount of from between about 0.001% and about 1% of said acidic injection medium.

5. The method of claim 1 wherein the acidic injection medium includes a member selected from the group consisting of hydrochloric acid, acetic acid, hydrofluoric acid, and mixtures thereof.

6. The method of claim 1 wherein the high alloy steel surface comprises about 22% by weight chrome and about 5% by weight nickel.

7. The method of claim 1 wherein the high alloy steel surface comprises about 13% by weight chrome.

8. The method of claim 1 the acid soluble copper metal salt is selected from the class consisting of cuprous chloride, copper acetate, cupric formate and cupric nitrate.

9. The method of treating a subterranean well for enhancement of production within the well, comprising the steps of:

(1) introducing and positioning within said well a high alloy steel surface exposable to a treatment fluid therethrough;

(2) introducing into said well a treatment fluid comprising a acidic injection medium, an acid corrosion inhibitor, and an intensifier said intensifier comprising an acid soluble copper metal salt;

(3) forming a fine film on said high alloy steel surface through which said fluid is introduced into said well by contacting said surface with said acid corrosion inhibitor in an amount of from between about 0.01% and about 6% of said acidic injection medium and said intensifier in an amount from between about 0.0001% and about 1% of said acidic injection medium, to thereby provide an electro-chemical attraction of the copper ion of said intensifier with said film to the high alloy steel surface; and (4) circulating said fluid into said well for contact with at least one production zone within said well.

10. The method of claim 9 wherein the acidic injection medium is a member selected from the class consisting of hydrochloric acid, acetic acid, hydrofloric acid, and sulfuric acid, and mixtures thereof.

11. The method of claim 9 wherein the intensifier is provided in said fluid independent of said acid corrosion inhibitor.

12. The method of claim 9 wherein said intensifier is provided as a component in the acid corrosion inhibitor.

13. The method of claim 9 wherein the intensifier is selected from the class consisting of cuprous chloride, copper acetate, cupric formate and cupric nitrate.

* * * * *